United States Patent [19]

Krantz

[11] Patent Number: 4,805,936

[45] Date of Patent: Feb. 21, 1989

[54] WHEELED SKI

[76] Inventor: Jeremy J. Krantz, 134 Strawtown Rd., West Nyack, N.Y. 10994

[21] Appl. No.: 135,598

[22] Filed: Dec. 21, 1987

[51] Int. Cl.[4] ..... A63C 17/04

[52] U.S. Cl. ..... 280/842; 152/8; 188/72.9; 280/11.2

[58] Field of Search ..... 280/11.1 BT, 11.2, 87.04 R, 280/87.04 A; 152/5, 8, 9; 188/24.21, 72.9

[56] References Cited

U.S. PATENT DOCUMENTS

| | | | |
|---|---|---|---|
| 3,827,706 | 8/1974 | Milliman | 280/11.1 BT |
| 4,076,266 | 2/1978 | Krausz | 280/11.2 X |
| 4,134,598 | 1/1979 | Urisaka | 280/11.1 BT X |
| 4,234,204 | 11/1980 | Tibbals | 280/11.2 X |
| 4,460,187 | 7/1984 | Shimizu | 280/11.1 BT |

FOREIGN PATENT DOCUMENTS

| | | | |
|---|---|---|---|
| 356487 | 3/1921 | Fed. Rep. of Germany | 280/11.2 |
| 2921606 | 12/1980 | Fed. Rep. of Germany | 280/11.1 BT |
| 523923 | 4/1955 | Italy | 280/11.1 BT |

*Primary Examiner*—David M. Mitchell
*Assistant Examiner*—Michael Mar
*Attorney, Agent, or Firm*—William E. Pelton

[57] ABSTRACT

Wheeled ski boards for off-road downhill skiing without snow are provided with a plurality of resiliently deformable off-road wheels and hand-held braking mechanisms for selectively controlling the speed and direction of travel of the ski boards.

3 Claims, 3 Drawing Sheets

WHEELED SKI

FIELD OF THE INVENTION

The present invention relates to recreational sporting goods and in particular to skiing paraphernalia consisting of a pair of wheeled ski boards adapted for off road downhill and cross country skiing with or without snow.

BACKGROUND OF THE INVENTION

Wheeled skis have been known heretofore. For example, wheeled skis are disclosed in U.S. Pat. No. 3,827,706 to Milliman and U.S. Pat. No. 4,460,187 to Shimizu. The prior type of wheeled skis however have been designed for use on paved roadway. While such prior wheeled skis are capable of being used to simulate some maneuvers of snow skiing, they are not suitable for simulating the actual conditions of snow skiing because they cannot effectively be used off road on downhill ski slopes, on cross country trails or on other unpaved ground surfaces.

Another disadvantage of the prior art wheeled skis is that they do not demonstrate an adequate system for braking or otherwise controlling the speed and direction of the movement. For example, the U.S. Pat. No. 4,460,187 to Shimizu shows that the rider or operator of the skis is required to hold on to a rope or bridle connected between the tips of each ski and to pull back on the bridle so as to tilt the skis to permit a brake pad on the back end of each ski to contact the ground. Such a braking mechanism would be totally unacceptable on an off road ski slope. It would be dangerous for the rider to tilt backwards, possibly losing balance and control. In contrast, the present invention provides a braking system which operates selectively on the back wheels of each ski. In the preferred embodiment, the braking system is controlled by a hand held brake connected to the wheel mechanism through a conventional cable.

It is a principal object of the present invention to provide an off road wheeled ski which simulates closely the actual maneuvers and conditions of snow skiing under off road conditions such as unpaved hillsides and on cross country and off season conventional ski slopes.

Another object of the present invention is to provide a pair of wheeled skis which may be mounted on conventional ski boots. The speed and direction of movement is controlled through the correct balance of the body of the skier and selective use of the braking system thereby to simulate conventional snow skiing motion.

Still another object of the present invention is to provide a pair of wheeled skis having a braking system acting on each ski which, through proper manipulation, enables the skier to simulate the conditions of traditional snow skiing.

A further object of the present invention is to provide a pair of wheeled skis which may be used during the snow season especially on relatively hard-packed groomed or even ungroomed but otherwise well used ski trails.

A still further object of the present invention is to provide a pair of wheeled axis which will be comparatively simple in construction and at the same time desirably rigid, strong and durable.

SUMMARY OF THE INVENTION

In contrast to the prior art, the present invention relates to a pair of skis which are adapted for off road use on hillside ski slopes and cross country trails. This is accomplished through the use of a plurality of enlarged off road wheels fixed to the bottom of each ski. The wheels may be made of appropriately deformable and resilient material or may be softly inflatable. The wheeled ski members are preferably adapted in shape to simulate closely the appearance of conventional snow skis. The length of each ski member may be selected to suit individual taste. Each of the ski members is provided with at least two off road relatively large and resiliently deformable wheels, one at each end of the ski. In the preferred embodiment, two wheels are situated near the back of the ski and are adapted to operate on a common axle. A third off road wheel is located toward the front end of each ski and is pivoted on a caster to provide directional capability. The rear wheels are each provided with a brake system, preferably a caliper type of brake mechanism, which is controlled by a hand held lever. The hand held lever is connected with the brake through a conventional cable which may be of the type commonly employed in connection with bicycle brakes. The brake lever may be mounted on ordinary ski poles. One brake cable per ski is sufficient to meet the braking requirements. In this way the rider holds one brake lever in each hand thereby further simulating the feeling of conventional snow skiing.

The skis may be connected to the rider through conventional ski bindings of the downhill or cross country variety. Alternatively the rider may simply stand on a non-skid agent applied to the upper surface of each ski. The shape of the skis is preferably that of the conventional snow ski but may be of any desired shape.

BRIEF DESCRIPTION OF THE DRAWINGS

For a more complete understanding of the present invention, reference may be had to the accompanying drawings in which:

FIG. 4(*a*) is a sectional front elevation view of the wheel of FIG. 4;

FIG. 4(*b*) shows the wheel of FIG. 4(*a*) resiliently deformed due to the slope of the terrain being traversed by the ski of the present invention;

DESCRIPTION OF THE PREFERRED EMBODIMENTS

Figure 1:
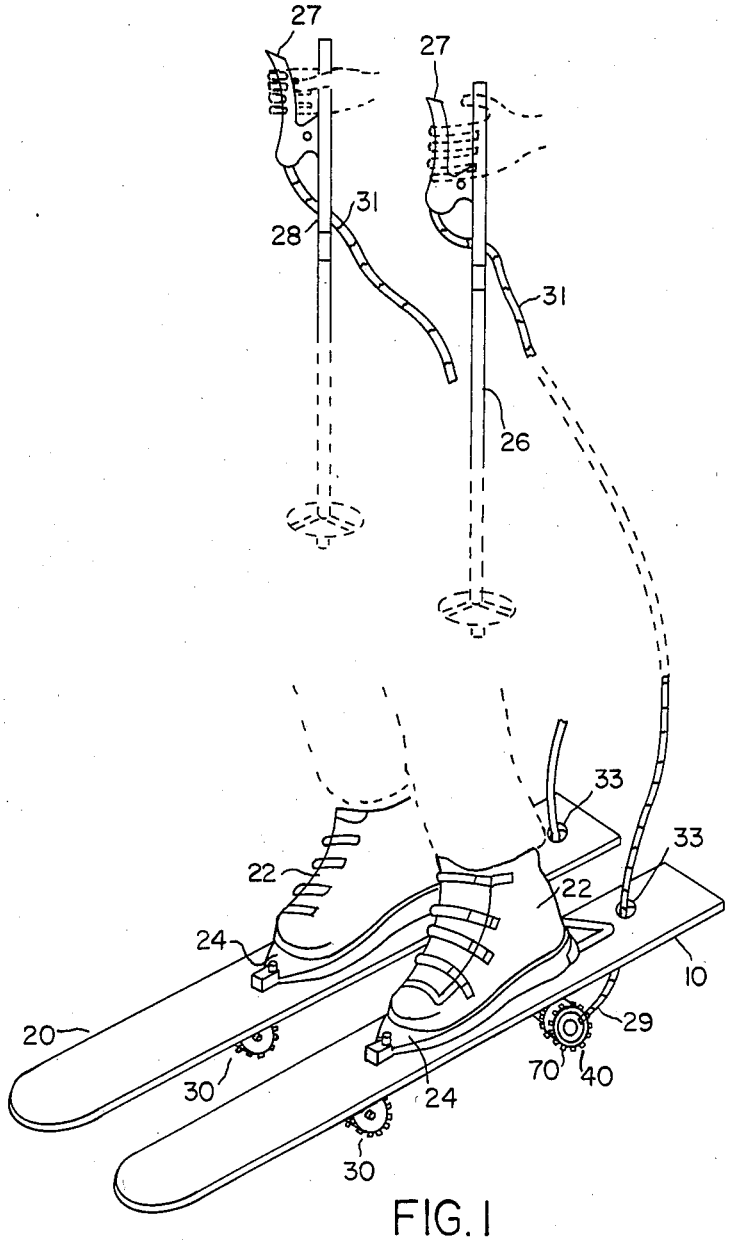
FIG. 1 is a perspective view of an embodiment of a pair of wheeled skis in accordance with the present invention including caliper type brake means attached thereto with actuating means for the brake attached to ski poles.

Referring now to the drawings and, in particular, to FIG. 1, there is shown a pair of skis, the left ski being indicated at 10 and the right ski indicated at 20. Ski boots 22 and conventional bindings 24, located at the central portion of the skis, are shown, together with left and right ski poles indicated at 26 and 28 respectively. An actuating grip 27 is attached to each of the ski poles. Each of the grips 27 constitutes a pivotally mounted lever which, when squeezed, operates a conventional cable operated caliper brake 29 shown in more detail in FIGS. 2, 3 and 5. A cable 31 interconnects each of the grips 27 and a respective one of the caliper brakes 29. In one embodiment, the cables 31, pass through respective openings 33 on each of the skis 10, 20 to engage the caliper brake 29 on the underside of the ski. It should be understood that the cables 31 may be guided or retained in any appropriate way to ensure that they do not become ensnarled in the wheels of the skis.

Figure 2:
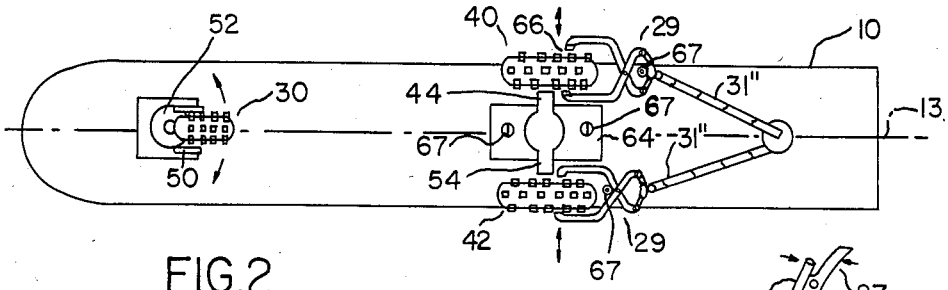
FIG. 2 is a bottom plan view of a wheeled ski in accordance with the present invention.
Figure 3:
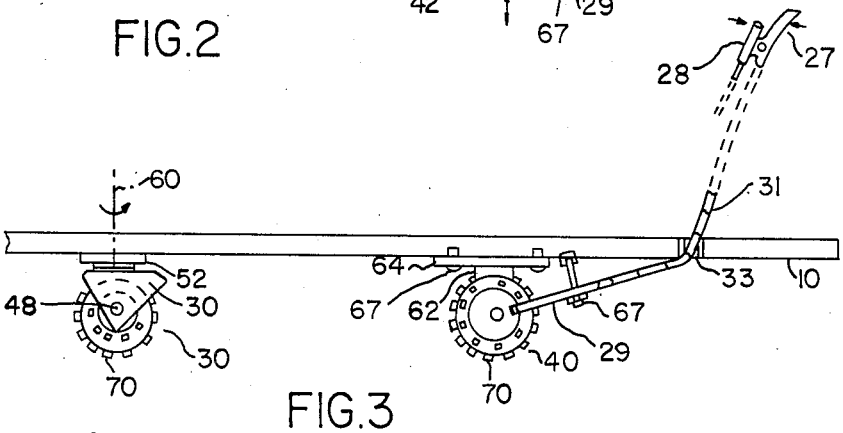
FIG. 3 is a side elevation view of the ski of FIG. 2.

In the embodiment shown in FIGS. 1–3, each ski 10, 20, has affixed to the underside of its front portion, substantially on its longitudinal axis, a steerable, pivotally mounted, e.g. caster mounted, front wheel 30. Also, each such ski has affixed to the underside of its rear portion a pair of laterally opposed and spaced apart rear wheels 40, 42 rotatably mounted on a stationary axle 44 and arranged substantially symmetrically about the longitudinal axis 13 of the ski, as shown more clearly in FIGS. 2 and 3. With reference particularly to FIGS. 2 and 3, the front wheel 30 is rotatably engaged on an axle 48 in a conventional caster mounting 50 which is rotatable about an axis 60 due to the rotatable engagement of caster 50 with an conventional journal bearing 52. Rear wheels 40, 42, as previously noted, are spaced apart laterally, and are rotatably mounted on the axle 44 which is engaged to the ski 10 by way of pedestal and mounting plate 64 fixed to the underside of the ski, e.g. by bolts as indicated at 67. It should be understood that the present invention is not limited to the use of a pair of rear wheels. It may be preferable in some circumstance to employ a single enlarged wheel at the rear of each ski which is softly inflated or otherwise deformable sufficiently to assure stability. Also, while the preferred embodiment hereof employs rear wheels which do not pivot, it should be understood that for some purposes it may be preferable for the rear wheels to be pivotally mounted on the ski and the front wheel unable to pivot. In this regard the invention also includes reversing the wheel configuration shown in FIGS. 1–3. For example, the two wheels 40 and 42 may be mounted at the front of the ski and the wheel 30 pivotally mounted at the rear portion of the ski. For some persons, this arrangement may be considered more likely to simulate the movements of traditional snow skiing. The scope of the present invention is not to be limited in this regard.

Caliper brakes 29, which may be of the commonly used "bicycle brake" type, modified to be smaller in size to accommodate a much smaller wheel, are affixed to the underside of the ski 10 by a clamp bolt 67. The caliper brakes are actuated by squeezing the pivoted grip 27 and the handle of ski pole 28 to cause the cable 31 to apply tension on its branches 31′ and 31″ and thereby cause a pair of opposed brake pads 66 to bear against opposite sides of a rim 68 formed as part of each of the wheels 40, 42.

As depicted herein, the caliper brakes are exposed and unprotected from impacting with adverse environmental conditions. It should be understood that the calipers may be enclosed within a suitable protective cover (not shown) to avoid potential damage to the brake mechanisms or to prevent the mechanism from becoming clogged or jammed because of dirt, snow, ice or the like.

Figure 4:
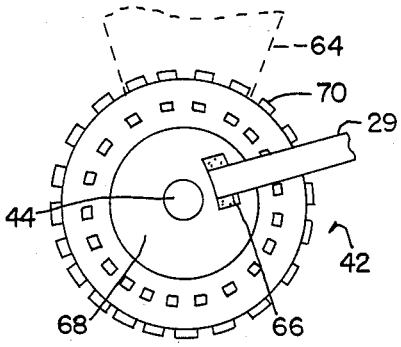
FIG. 4 is a side elevation view of a wheel for use with the ski device of the present invention.
Figure 4A:
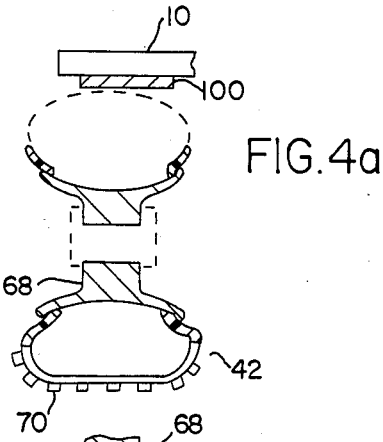
Figure 4B:
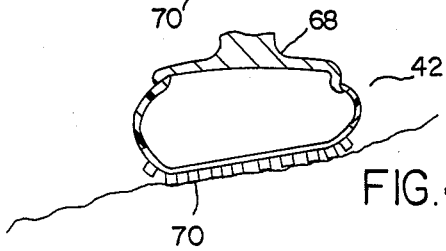

The wheels 40, 42 are preferably configured in the manner of off-the-road bicycle tires, having a raised rubber cleat-like tread as indicated at 70 in FIG. 4. Each wheel of this type is designed to operate at low inflation pressure, e.g. 15–25 psi. As such, each wheel is highly flexible and resilient so as to provide a substantial segment of essentially flat tread and to deform in cross-section to maintain the ski in a stable position under down hill and cross-slope conditions of travel as illustrated in FIGS. 4(*a*) and 4(*b*) respectively. The wheels may also be formed completely of resiliently deformable material, having a toughened outer layer in which an appropriate tread is formed. The wheels preferably have a diameter large enough to permit sufficient deformation during cross-slope traversing maneuvers so that the ski remains relatively horizontal along its lateral axis.

In operation, the skier engages the boots in the bindings of the skis and proceeds to maneuver on terrain similar to or on a snow-covered ski slope, selectively actuating the respective caliper brakes to control the speed and direction of movement, in place of the usual "snow-plow" or other techniques known in snow skiing for slowing down or controlling a change of direction. The flexible, resilient, low pressure rubber wheels deform to accommodate terrain variations and the raised cleat-like treads avoid excessive slipping and sliding. In a particular embodiment, natural rubber is employed as the tread material to enhance flexibility, resilience and tear strength on uneven terrain. The skis can be long or short and a non-skid central portion upper surface can be used in place of bindings as described in U.S. Pat. No. 4,460,187.

Figure 5:
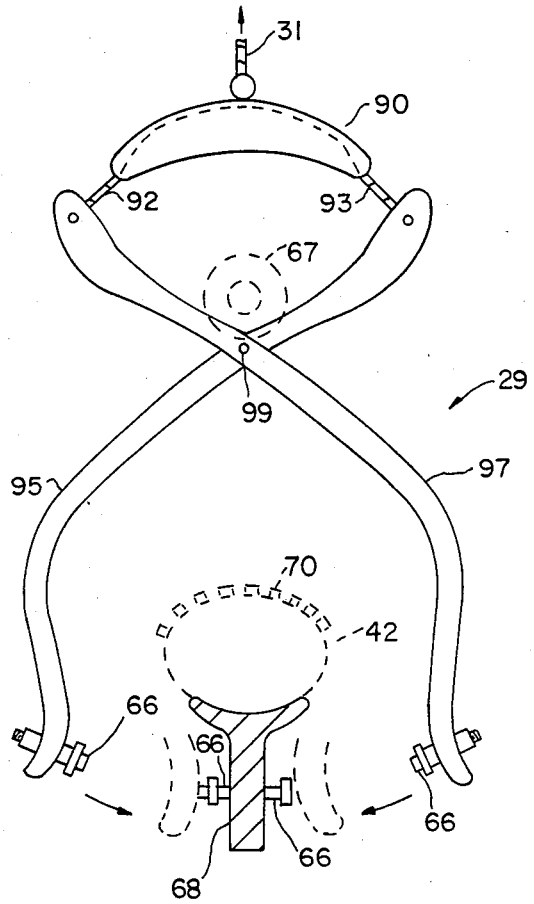
FIG. 5 shows, schematically, a caliper type brake useable with the present invention.

FIG. 5 shows, somewhat schematically, a caliper brake assembly for braking a rear ski wheel. The assembly 29 is about ¼ the size of a bicycle caliper brake assembly and comprises a yoke 90 engaging the cable 31 with cable branches 92, 93 engaged to bowed arms 95, 97. The arms 95, 97 are pivoted at 99 and when tension is applied to the cable 31, e.g. by squeezing an actuating grip 27, a brake shoe 66 is pressed against opposite surfaces of the rim 68 of the wheel thereby to apply friction thereto and slow the rotational speed of the wheel.

The caliper brakes may be operated by the feet and not by the hands, if desired. For example, each ski might be provided with a depressible button on or near its foot bearing surface. The button is mechanically interconnected through suitable linkage elements to the calipers on the underside of the ski. In such an arrangement, pressure on the button would cause the button to be depressed which movement acts through the linkage to manipulate the calipers.

Other braking arrangements can be used without departing from the scope of the invention. For example, one or more concentric disks can be fixed to a rotating wheel hub or to a rotating axle and the caliper brakes positioned to apply pressure to such disks. In practice it may not be deemed necessary to have a separate brake for each of the two rear wheels on the ski. Also the brake system need not be limited to the use of calipers, depending on the desired sophistication of the apparatus. Drum brakes or a brake system operated entirely by shifting one's weight on the skis may be employed. Such a weight operated brake system could, by way of example, utilize a friction pad 100 (FIG. 4(*a*)) mounted on the undersurface of each ski directly above each of the rear wheels. If such a brake mechanism is utilized, the ski is pivotally mounted to the rear wheel pedestal and mounting plate 64 so that it may be rocked in either direction laterally about its longitudinal axis. The operator causes the ski to rock by simply shifting weight to the inside or outside of the ski, as in traditional skiing. In this way the friction pads on the undersurface of the ski may be brought into contact with respective rear wheels to diminish the speed. Such a weight operated brake system may be used as desired with or without the hand operated caliper brakes described herein. In addition, such rocking movement of the ski may be adapted through suitable mechanical linkage to operate more sophisticated compression or expansion braking mechanisms such as the drum type brakes mentioned above.

While the present invention has been described by way of specific embodiments it should be understood that appropriate modification may be made by those skilled in the art and that the scope of the invention is limited only by the following claims.

I claim

1. A pair of off-road roller skis, each ski comprising:

an elongate, generally planar ski member having a front end, a central portion, and a rear end;

said central portion having a foot receiving area for receiving a foot of a rider;

a steerable off-road front caster wheel pivotally mounted at said front end;

inner and outer off-road rear wheels consisting of soft pneumatic tires, said rear wheel being carried in spaced apart relation by a stationary axle mounted at said rear end perpendicular to the elongate dimension of said ski members, each of said wheels being located beneath and within the peripheral boundary of said ski members;

each of said rear wheels being resiliently deformable and pressurized in the range of about 15 to 25 psi to accommodate an off-road surface; and hand brake means manually actuable by a rider for variably opposing rotation of at least one of said rear wheels.

2. The apparatus of claim 1 in which said brake means comprise means actuable by hand and acting on at least one of said wheels for selectively controlling rotation thereof.

3. The apparatus of claim 2 in which said brake means is selectively actuable simultaneously to control rotation of said pair of wheels relative to said pivotally mounted wheel.

* * * * *